US005787863A

United States Patent [19]

Henig et al.

[11] Patent Number: 5,787,863

[45] Date of Patent: Aug. 4, 1998

[54] FUEL SYSTEM HAVING PRIMING ACTUATING FLUID ACCUMULATOR

[75] Inventors: Yitshak I. Henig, Billericay, United Kingdom; Richard H. Holtman, Dunlap, Ill.

[73] Assignees: Caterpillar Inc., Peoria, Ill.; Ford Motor Company, Dearborn, Mich.

[21] Appl. No.: 590,182

[22] Filed: Jan. 23, 1996

[51] Int. Cl.[6] ..... F02M 37/20

[52] U.S. Cl. ..... 123/447

[58] Field of Search ..... 123/446, 447, 123/456, 179.9, 179.17

[56] References Cited

U.S. PATENT DOCUMENTS

| | | | |
|---|---|---|---|
| 4,421,088 | 12/1983 | Seilly | 123/447 |
| 4,485,789 | 12/1984 | Walter et al. | 123/467 |
| 4,728,074 | 3/1988 | Igashira et al. | 123/447 |
| 4,884,545 | 12/1989 | Mathis | 123/447 |
| 5,169,855 | 12/1992 | Stone | 123/446 |
| 5,176,115 | 1/1993 | Campion | 123/179.17 |
| 5,181,494 | 1/1993 | Ausman et al. | 123/446 |
| 5,191,867 | 3/1993 | Glassey | 123/446 |
| 5,213,083 | 5/1993 | Glassey | 123/447 |
| 5,245,970 | 9/1993 | Iwaszkiewicz et al. | 123/447 |
| 5,297,523 | 3/1994 | Hafner et al. | 123/456 |
| 5,372,116 | 12/1994 | Davis | 123/447 |
| 5,456,233 | 10/1995 | Felhofer | 123/447 |

*Primary Examiner*—Thomas N. Moulis

*Attorney, Agent, or Firm*—Marshall, O'Toole, Gerstein, Murray & Borun; William B. McCracken

[57] ABSTRACT

A fuel system for a fuel injected engine includes a manifold for supplying actuating fluid to a plurality of fuel injectors and an accumulator in fluid communication with the manifold. The accumulator is charged while the engine is running by an actuating fluid pump coupled to the manifold. After the engine has been shut off and a particular engine condition is detected, actuating fluid is supplied to the manifold by the accumulator to fill voids left by contracting actuating fluid.

13 Claims, 2 Drawing Sheets

FUEL SYSTEM HAVING PRIMING ACTUATING FLUID ACCUMULATOR

TECHNICAL FIELD

The present invention relates to a fuel system of a fuel injected engine and more particularly to a priming actuating fluid accumulator connected to an actuating fluid manifold.

BACKGROUND ART

In the construction of diesel engines, particularly diesel engines of earthworking machines, space is severely limited for locating and positioning various components of the engine and components associated with the engine. It has also been a problem to maintain actuating fluid lines which power the fuel injectors filled to capacity during periods when the engine is shut down for an extended period and/or during cold weather conditions. During such times, actuating fluid occasionally drains out of the system and/or the volume of actuating fluid decreases in response to cooling thereof. This reduction in the volume of actuating fluid can result in the introduction of air into the system, leading to an undesirable increase in cranking times during cold-weather starts. In order to overcome this problem, actuating fluid must be supplied to the system so that sufficient pressure can be developed to inject fuel into the combustion chambers and start the engine.

Glassey, U.S. Pat. No. 5,213,083, assigned to the assignee of the instant application, discloses a hydraulically actuated fuel injection system including a high pressure actuating fluid pump for developing high pressure actuating fluid for fuel injectors and a priming reservoir arranged in fluid communication between a sump and an inlet of the pump. The priming reservoir primes and thereby facilitates rapid pressurization of the high pressure pump during engine start-up so that long cranking times are avoided. In addition, means are provided for automatically making up or replenishing voids in manifolds downstream of the pump due to cooling and contraction of actuating fluid and/or precipitation of entrained air from the actuating fluid. Such means comprises an actuating fluid siphon passage having a check valve therein which bypasses the inlet of the high pressure pump and is connected directly between the priming reservoir and the manifolds.

While the fuel injection system disclosed in the above-identified Glassey '083 patent is effective to limit cranking times, it is necessary that the lowest level of the actuating fluid in the reservoir be higher than the pump inlet. In installations where sufficient space above the pump mounting location or oil manifolds is not available or in a situation where the pump mounting location is at a low elevation compared to the engine head and injectors, the system disclosed in Glassey '083 patent may not be suitable.

The present invention is directed to overcoming one or more of the problems as set forth above.

DISCLOSURE OF THE INVENTION

In accordance with one aspect of the present invention, a fuel system for a fuel injected engine having a fuel injector which is actuatable by an actuating fluid includes a pump for pressurizing actuating fluid and a manifold coupled between the pump and the fuel injector and transmitting pressurized actuating fluid from the pump to the fuel injector. An accumulator is coupled to the manifold for supplying pressurized actuating fluid to the manifold.

Preferably, a pressure control valve and a check valve are coupled between the manifold and the pump. Also preferably, the accumulator is directly connected to and charged by the manifold. Still further in accordance with the preferred embodiment, a control valve is responsive to an engine condition and is coupled between the accumulator and the manifold. The control valve is preferably responsive to engine temperature, electrically operable and actuated by an engine electronic control.

In accordance with an alternative embodiment, an orifice is coupled between the accumulator and the manifold. Also, the actuating fluid preferably comprises engine oil.

In accordance with another aspect of the present invention, a hydraulically-actuated fuel system for a diesel engine having a plurality of fuel injectors each of which is actuable by an actuating fluid when the engine is running includes a high pressure pump operable when the engine is running for pressurizing actuating fluid and a manifold coupled between the pump and the fuel injectors and transmitting pressurized actuating fluid from the pump to the fuel injectors. An accumulator is coupled to the manifold for supplying pressurized actuating fluid thereto when the engine is not running and means are coupled between the accumulator and the manifold for controlling the passage of pressurized actuating fluid from the accumulator to the manifold.

In accordance with yet another aspect of the present invention, a hydraulically-actuated fuel system for a diesel engine having a plurality of fuel injectors each of which is actuable by high pressure engine oil when the engine is running includes a high pressure pump operable when the engine is running for pressurizing engine oil and a rail pressure control valve coupled between the pump and a high pressure oil conduit. A pressure control valve and a check valve are coupled in the high pressure oil conduit and a manifold is coupled between the high pressure oil conduit and the fuel injectors and transmits high pressure engine oil from the pump to the fuel injectors. An accumulator is directly coupled to the manifold for supplying high pressure engine oil thereto when the engine is not running wherein the accumulator is charged by the manifold when the engine is running. Means are coupled between the accumulator and the manifold for controlling the passage of high pressure engine oil from the accumulator to the manifold.

The present invention reduces cranking times by providing actuating fluid as required to an actuating fluid manifold and is suitable for installation in locations where sufficient space above the pump mounting location or the manifold is unavailable or where the pump mounting location is physically low compared to the engine head and the fuel injectors. Further, as compared to systems where the reservoir is integral with the high pressure pump, the complexity of the oil pump is advantageously reduced.

BEST MODE FOR CARRYING OUT THE INVENTION

Figure 1:
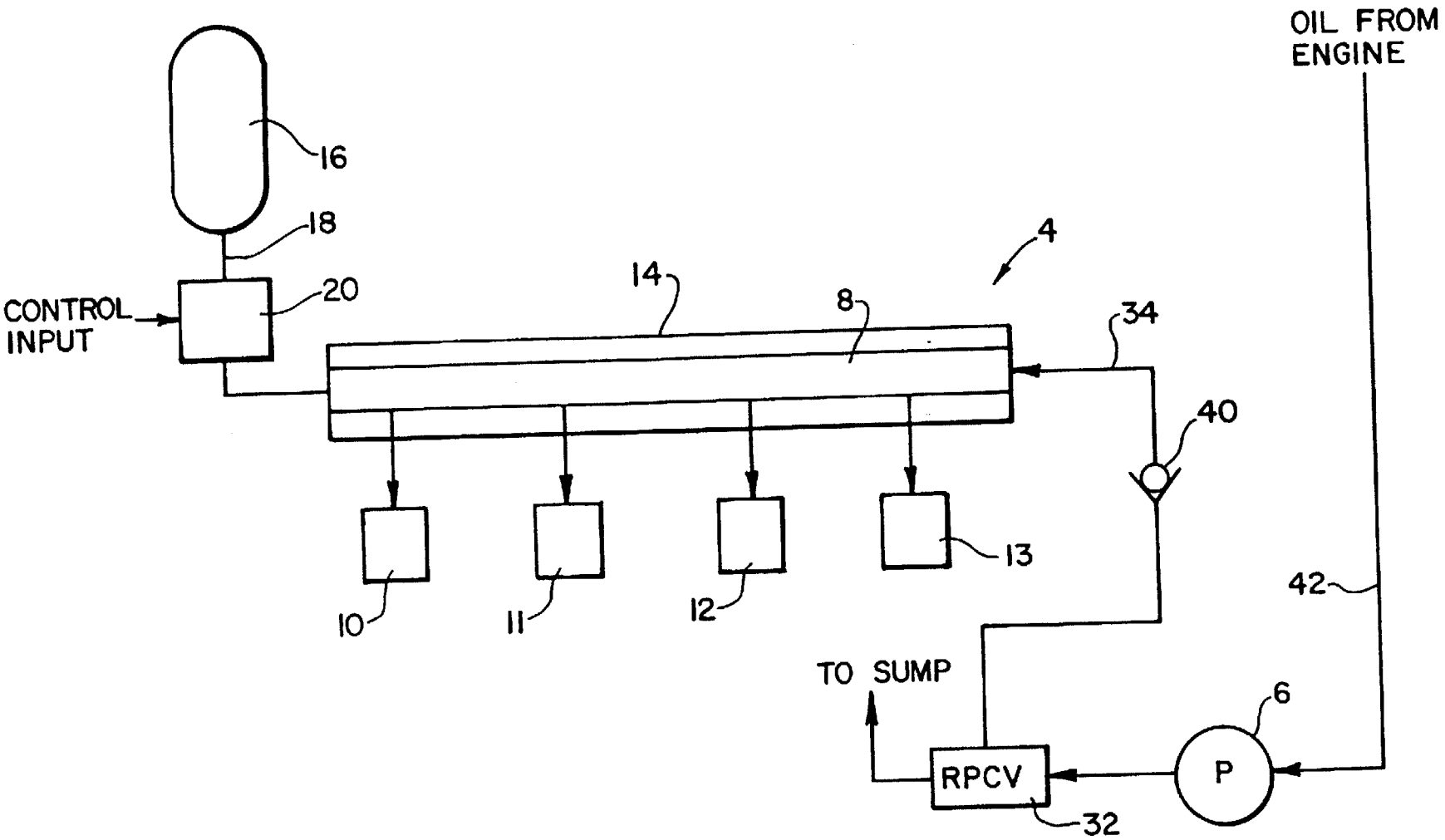
FIG. 1 is a diagrammatic view of a first embodiment of the fuel system of the present invention.

Referring to the FIG. 1, a fuel injected engine, preferably a diesel engine, includes a fuel system 4 having a high pressure actuating fluid pump 6 connected to and in fluid communication with a high pressure actuating fluid manifold 8. As is further known in the art, the manifold 8 is connected to a plurality of fuel injectors 10–13 for controllably supplying fuel to a like number of combustion chambers (not shown) of the engine. While four fuel injectors 10–13 for supplying fuel to four associated combustion chambers are shown in the Figures the engine may include a different number of fuel injectors and associated combustion chambers. Further, one or more additional manifolds may be provided wherein each manifold supplies fuel to a portion of the total number of fuel injectors of the engine, if desired.

A housing 14 is positioned about the high pressure actuating fluid manifold 8. An actuating fluid accumulator 16 separate from the manifold 8 is disposed in fluid communication with the manifold 8 by a first conduit 18. The accumulator 16 may be separate from the housing 14 and located remotely therefrom at an elevation above or below the manifold 8, as desired. Alternatively, the accumulator 16 may be located in the housing 14.

In accordance with the embodiment of FIG. 1, a control valve 20 responsive to an engine condition, such as engine or actuating fluid temperature, is disposed in the first conduit 18 and controls the flow of actuating fluid between the accumulator 16 and the manifold 18.

A rail pressure control valve 32 is disposed in fluid communication between the pump 6 and a high pressure conduit 34 coupled to the manifold 8 and controls the fluid pressure of the actuating fluid supplied thereto. A check valve 40 is disposed in the conduit 34 and permits only one-way fluid flow from the rail pressure control valve 32 to the manifold 8.

Preferably, the actuating fluid comprises engine oil and a conduit 42 is coupled to an actuating fluid supply circuit including a transfer pump (not shown) for transferring engine oil to the reservoir 16.

In the event that the engine includes multiple manifolds each supplying actuating fluid to a portion of the total number of fuel injectors of the engine, each manifold may be coupled to an associated accumulator via a control valve. Alternatively, a first plurality of manifolds and associated control valves may be connected to a second plurality of accumulators, as desired. Further, all of the manifolds are preferably coupled to the rail pressure control valve 32, or a separate rail pressure control valve having an inlet coupled to the outlet of the pump 6 is provided for each manifold.

Industrial Applicability

As the engine is running, pressurized actuating fluid is delivered by the pump 6 to the manifold(s) 8 to pressurize the latter. The control valve 20 allows fluid communication during this time from the manifold 8 to the accumulator 16 to charge the accumulator 16 but prevents discharging of the accumulator 16 back through the rail pressure control valve 32 to sump.

After engine shut-down, cooling and contraction of actuating fluid and/or precipitation of entrained air from the actuating fluid can create voids in the manifold 8. This lost volume of actuating fluid in the manifold 8 can result in a delay in engine start-up during cranking until the pump 6 is able to refill the lost volume in the manifold 8. In order to reduce or eliminate this problem, the manifold 8 is kept in a filled condition through makeup of actuating fluid from the accumulator 16 through the first conduit 18 and the control valve 20. In this regard, the control valve 20, which may be thermostatically controlled or operated by an engine control module, inhibits the flow of actuating fluid from the accumulator 16 to the manifold 8 until the engine or actuating fluid temperature has dropped below a particular level or until a predetermined time period has passed since the engine was turned off. This insures that the accumulator 16 is not placed in fluid communication with the manifold 8 until the opportunity has arisen for voids to form in the latter.

As actuating fluid is transferred from the accumulator 16 to the manifold 8, voids are refilled by actuating fluid. The check valve 40 prevents venting of actuating fluid through the rail pressure control valve 32 to sump.

Figure 2:
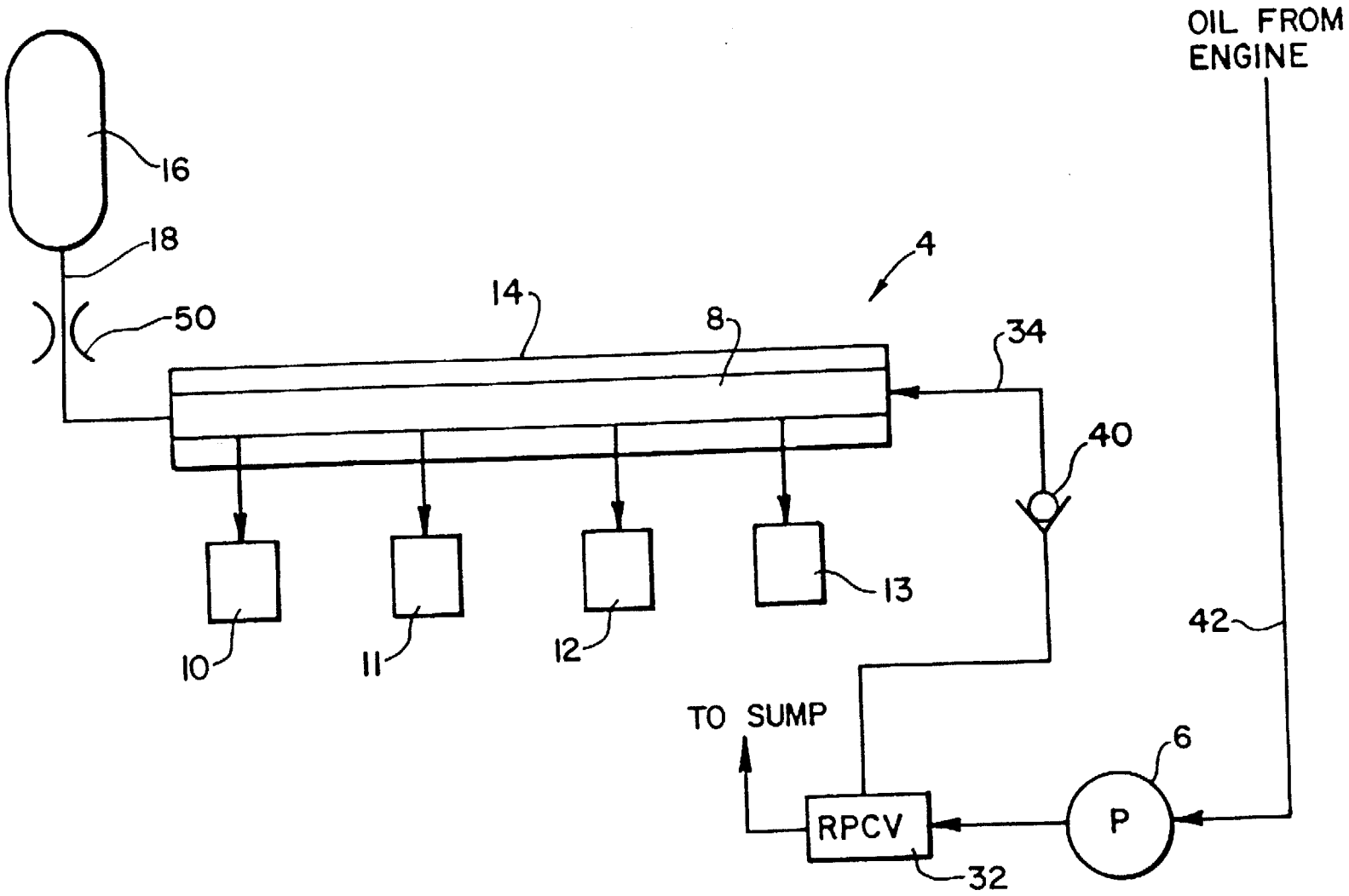
FIG. 2 is a diagrammatic view of a second embodiment of the fuel system of the present invention.

FIG. 2 illustrates a modification to the embodiment of FIG. 1 to obtain a further embodiment of the present invention. As seen in FIG. 2, the control valve 20 is replaced by a small restriction in the form of an orifice 50. The orifice 50 allows a continuous supply of actuating fluid to flow to the manifold 8. The size of the orifice is related to the volume of the accumulator 16 and the manifold 8 and the cooling rate of the actuating fluid.

The present invention is effective to provide quick start-ups of the engine and is suitable for installation in locations where only limited space above the pump mounting location or the manifold is available or where the pump is mounted at a location below the engine head and the injectors. Specifically, use of the accumulator 16 permits the manifold 8 to be continuously charged with actuating fluid even while the engine is not running. Further, as noted above, because the accumulator 16 is pressurized, it can be located at any convenient location, including an elevation lower than the manifold 8, if desired.

The present invention also advantageously results in reduced complexity of the oil pump as compared to other systems where the reservoir is incorporated in a housing with the pump and may result in lower overall costs.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. A hydraulically-actuated fuel system for a diesel engine having a plurality of fuel injectors each of which is actuable by an actuating fluid when the engine is running, comprising:

a high pressure pump operable when the engine is running for pressurizing actuating fluid;

a manifold coupled between the pump and the fuel injectors and transmitting pressurized actuating fluid from the pump to the fuel injectors;

an accumulator coupled to the manifold for supplying pressurized actuating fluid to the manifold when the engine is not running; and means coupled between the accumulator and the manifold for controlling the passage of pressurized actuating fluid from the accumulator to the manifold.

2. The hydraulically-actuated fuel system of claim 1, wherein the controlling means comprises a control valve responsive to an engine condition.

3. The hydraulically-actuated fuel system of claim 2, wherein the control valve is responsive to engine temperature.

4. The hydraulically-actuated fuel system of claim 2, wherein the control valve is actuable by an engine electronic control.

5. The hydraulically-actuated fuel system of claim 1, wherein the controlling means comprises an orifice coupled between the accumulator and the manifold.

6. The hydraulically-actuated fuel system of claim 1, further including a pressure control valve and a check valve coupled between the manifold and the pump.

7. The fuel system of claim 1, wherein the actuating fluid comprises engine oil.

8. A hydraulically-actuated fuel system for a diesel engine having a plurality of fuel injectors each of which is actuable by an actuating fluid when the engine is running, comprising:

a high pressure pump operable when the engine is running for pressurizing actuating fluid;

a manifold coupled between the pump and the fuel injectors and transmitting pressurized actuating fluid from the pump to the fuel injectors;

an accumulator coupled to the manifold for supplying pressurized actuating fluid to the manifold when the engine is not running wherein the accumulator is directly connected to and charged by the manifold when the engine is running; and means coupled between the accumulator and the manifold for controlling the passage of pressurized actuating fluid from the accumulator to the manifold.

9. A hydraulically-actuated fuel system for a diesel engine having a plurality of fuel injectors each of which is actuable by high pressure engine oil when the engine is running, comprising:

a high pressure pump operable when the engine is running for pressurizing engine oil;

a rail pressure control valve coupled between the pump and a high pressure oil conduit;

a pressure control valve and a check valve coupled in the high pressure oil conduit;

a manifold coupled between the high pressure oil conduit and the fuel injectors and transmitting high pressure engine oil from the pump to the fuel injectors;

an accumulator directly coupled to the manifold for supplying high pressure engine oil to the manifold when the engine is not running wherein the accumulator is charged by the manifold when the engine is running; and means coupled between the accumulator and the manifold for controlling the passage of high pressure engine oil from the accumulator to the manifold.

10. The hydraulically-actuated fuel system of claim 9, wherein the controlling means comprises a control valve responsive to an engine condition.

11. The hydraulically-actuated fuel system of claim 10, wherein the control valve is responsive to engine temperature.

12. The hydraulically-actuated fuel system of claim 10, wherein the control valve is actuable by an engine electronic control.

13. The hydraulically-actuated fuel system of claim 9, wherein the controlling means comprises an orifice coupled between the accumulator and the manifold.

* * * * *